United States Patent [19]

Burton et al.

[11] 4,353,472

[45] Oct. 12, 1982

[54] CLOSURES FOR CONTAINERS

[75] Inventors: George W. Burton, London; Eugene F. Davis, Ilford, both of England

[73] Assignee: Johnsen & Jorgensen (Plastics) Limited, London, England

[21] Appl. No.: 230,416

[22] Filed: Feb. 2, 1981

[51] Int. Cl.[3] ..... B65D 55/02

[52] U.S. Cl. ..... 215/211; 215/224; 215/250

[58] Field of Search ..... 215/211, 224, 250

[56] References Cited

U.S. PATENT DOCUMENTS 3,896,958 7/1975 Robbins et al. ..... 215/21

4,121,727 10/1978 Robbins et al. ..... 215/211

*Primary Examiner*—George T. Hall

*Attorney, Agent, or Firm*—Newton, Hopkins & Ormsby

[57] ABSTRACT

A closure cap for closing the mouth of a container. The cap has a plug forming an inner member, and an outer member with a depending skirt. When the closure cap is in operative position on a container the inner member is arranged coaxially within the upper part of the outer member with the plug in position to close the mouth of the container. When in this position the upper part of the outer member is positioned above the mouth of the container and the skirt of the outer member embraces and engages with the outer surface of the container around the mouth.

6 Claims, 8 Drawing Figures

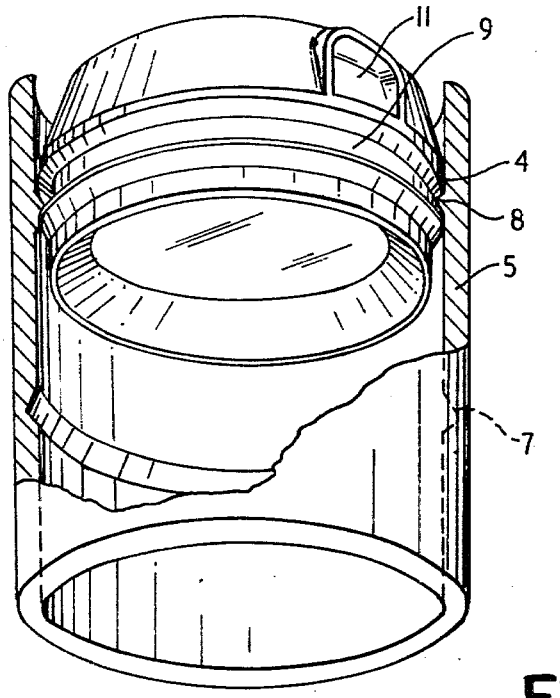
Fig.3.
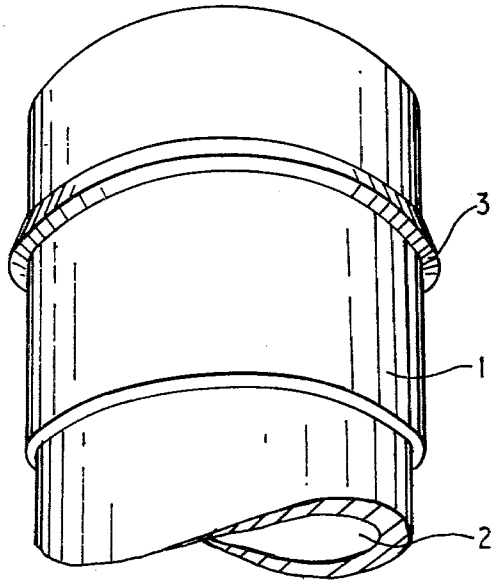

CLOSURES FOR CONTAINERS

This invention relates to the provision of a closure cap for a container and to a container and closure cap assembly. Children often attempt to tamper with containers of pills and the like and try to open such containers to get at the contents. Sometimes children have succeeded in opening a container of pills with tragic results. It is an object of the present invention to provide a container closure cap that is not easy to open simply by upward pressure. According to a feature of the invention there is provided a closure cap adapted for closing the mouth of a container characterised in that the closure cap comprises an inner member including a plug and an outer member including a depending skirt and further characterised in that when the closure cap is in operative position on a container the inner member is coaxially disposed within an upper part of the outer member with the plug seated in or over the mouth of the container so as to close the mouth, the upper part of the outer member is positioned above the mouth of the container and the skirt of the outer member is positioned so as to embrace and engage with the outer surface of the container around the mouth. When in operative position the inner member is disposed within the outer member with the top of the inner member flush with or below the top of the outer member so that it is very difficult to remove the inner member from the outer member. Preferably as an additional safety factor the inner member is shaped to engage with the outer member so that the inner member is positively held in position.

In one embodiment of the invention the inner member of the closure cap can be removed only when it has been turned into a predetermined position relatively to the outer member. This forms an additional child-resistant feature and also ensures that the closure cap can be removed and replaced by an adult as desired. In this embodiment the outer member of the closure cap has a gap or cut-out in its upper peripheral edge and the inner part has a thumb grip. The inner member is rotatable within the outer member but it is virtually impossible to push the inner member out of the outer member until the inner member is rotated to bring the thumb grip into alignment with the gap or cut out in the edge of the outer member. When in this position an interruption in a substantially annular bead on the inside of the outer member in the region of the gap or cut out is in alignment with the thumb grip and the inner member can then be removed from the outer member by a tilting and lifting movement, manipulating the inner member by means of the thumb grip.

The closure cap may be moulded as an integral unit with the inner member disposed co-axially above the outer member, the two parts being interconnected by a frangible connection which is broken when the closure cap is applied to the container, breaking being effected by downward movement of the inner member into the outer member to an operative position. Alternatively the closure cap may be moulded in two parts, an inner member and an outer member which may be formed simultaneously but separately in the same mould after which an assembly operation is carried out so that complete closure caps are discharged from the moulding machine. Other methods may, if desired, be used, for example with less sophisticated moulds the two parts of the closure cap may be moulded separately and may then be assembled by hand or by a suitable form of press tool or assembly machine.

In order that the invention may be more clearly understood reference is now directed to the accompanying drawings given by way of example in which.

Figure 4:
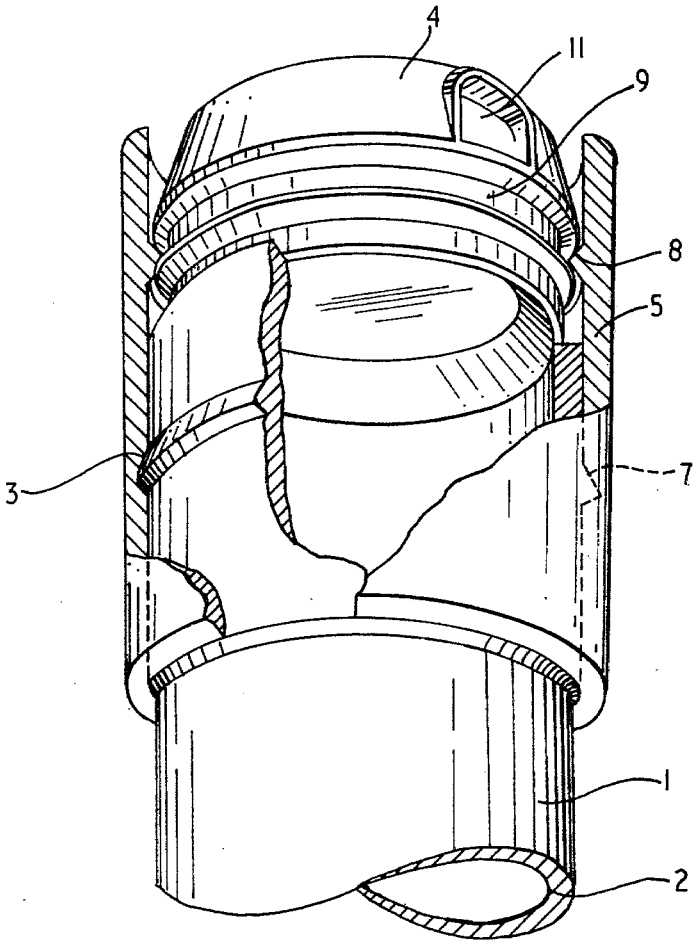
Figure 5:
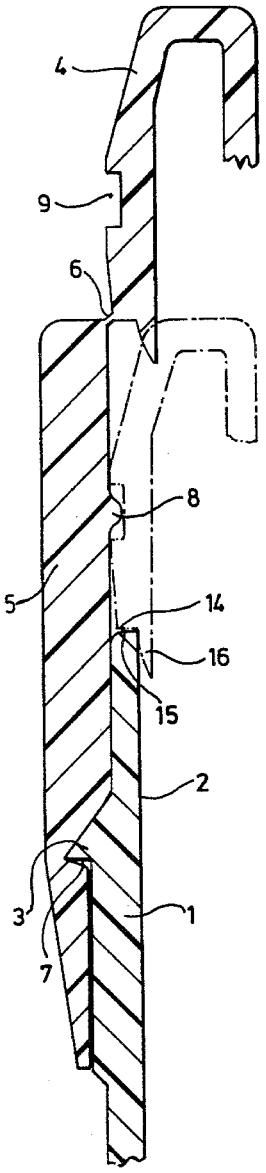

FIGS. 3 and 4 are respectively perspective sectional views of the closure cap before and after application to a container and FIG. 5 is a sectional view of an embodiment in which the two parts of the closure cap are formed as an integral unit and remain so until the closure cap is applied to a container. In this figure the closure cap is shown in position during application to a container and after it is in operative position.

Figure 6:
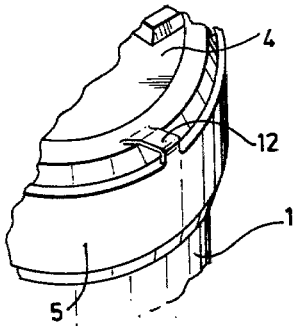
Figure 7:
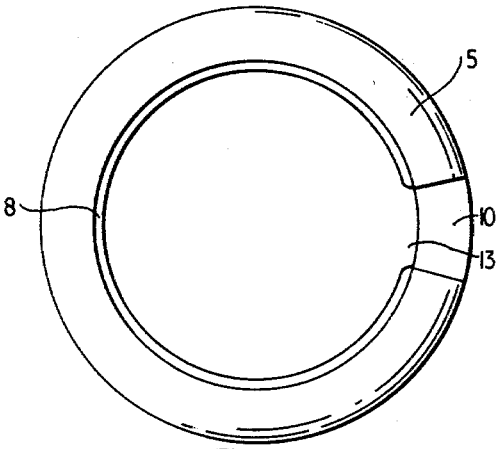
Figure 8:
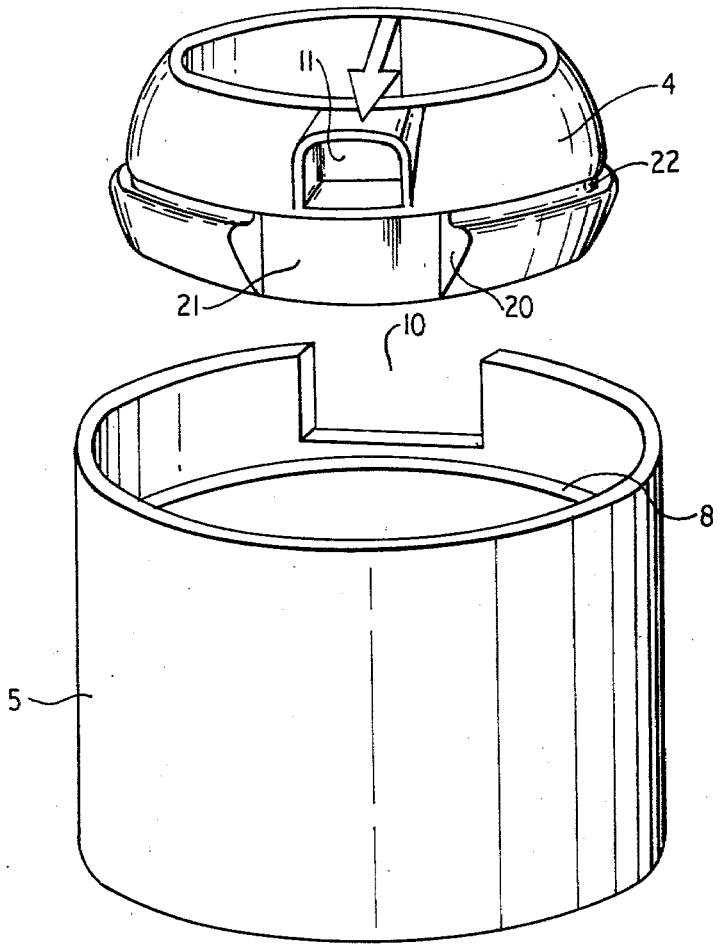

FIGS. 6 and 7 are detail views, and FIG. 8 is a modification.

Referring to the drawings, 1 is a container which has a smooth inner surface 2 and an outer annular projecting ring 3. A two part closure cap comprises an inner member 4 in the form of a plug and an outer member 5 in the form of a sleeve, the inner member 4 being disposed co-axially within the outer member 5. The outer member 5 has an internal annular recess 7 shaped to receive the annular projecting ring 3, the shape of the recess 7 and the ring 3 being such that it is relatively simple to push the outer member 5 downwardly over the ring 3 so that the ring 3 engages in the recess 7 but it is almost impossible to remove the member 5 again by a simple upward movement. The outer member 5 has an internal substantially annular bead 8 for engagement within an annular recess 9 in the outer surface of the inner member 4 and the outer member 5 also has an interruption 13 in the bead 8 forming a gap therein as indicated in FIG. 7. The inner member 4 has a thumb grip 11 and an embossed arrow or other mark on the top to indicate the position of the thumb grip 11. The interruption 13 in the substantially annular bead 8 is directly below or in the region of a gap or cut-out 10 in the peripheral top edge of the outer member 5 so that when upward pressure is applied to the thumb grip 11 of the inner member 4 through the gap or cut-out 10 the inner member 4 may be removed or pushed out of the outer member 5 in a tilting movement. It will be understood that pressure can be applied to the thumb grip 11 only when the inner member 4 is manipulated to bring the thumb grip 11 into registration with the gap or cut-out 10.

When upward pressure is applied to the thumb grip 11 to push the inner member 4 out of the outer member 5 to open the container 1 the inner member 4 first tilts because upward pressure on the thumb grip raises the near side of the inner member 4 so that the top of the inner member 4 inclines downwardly away from the gap or cut-out 10. In the opening movement therefore the inner member 4 may be described as being flicked out of the outer member 5. The assembly of the parts of the closure cap may be effected in such a way that the thumb grip 11 is out of registration with the gap or cut-out 10 in the periphery of the outer member 5 so that if the closure cap be applied automatically to a container, i.e by machine, the closure cap will be seated on the container in a child-resistant position. Then, in operation, to open the container a user moves the inner member 4 angularly relative to the outer member 5 until the thumb grip registers with the gap or cut-out 10 and then flicks out the inner member. To facilitate correct positioning of the inner member for opening the arrow or other indication referred to above may be provided on the top of the inner member, the inner member being pushed angularly around until the indicator points to the gap or cut-out 10. In this position a thumb of the user can be inserted through the gap or cut-out 10 and upward pressure then forces or flicks the inner member 4 out of the outer member 5.

Figure 1:
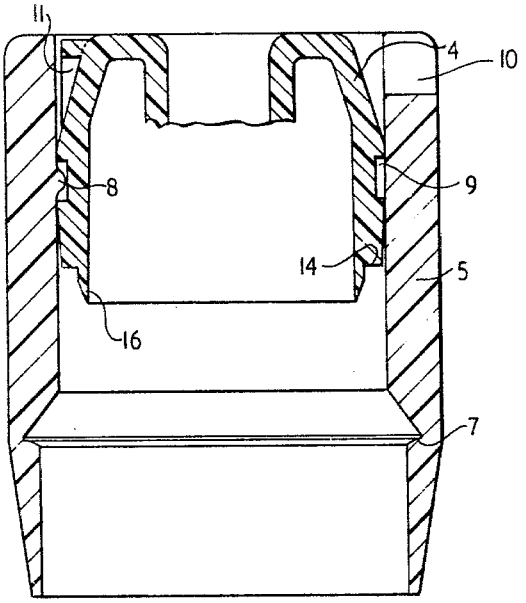
FIG. 1 shows a sectional view of one embodiment of a closure cap in accordance with the invention with the two parts of the closure cap formed separately.
Figure 2:
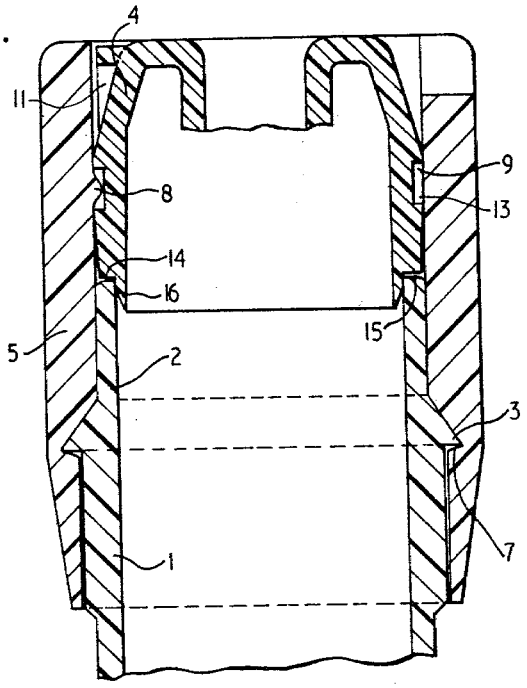
FIG. 2 shows the closure cap assembled on a container.

The outer surface of the inner member 4 is smooth except at the thumb grip 11 where it is stepped or otherwise shaped to enable a user to apply the required upward pressure to flick out the inner member 4. When the closure cap is in operative position as shown e.g in FIG. 2 a ledge 14 at the lower end of the inner member 4 sits on the edge 15 around the mouth of the container 1 while an annular depending portion 16 of the inner member 4 enters the mouth of the container 1 so that the inner member 4 of the closure cap turns on the edge of the mouth of the container 1 when the inner member 4 is manipulated relatively to the outer member 5.

Referring now to FIG. 5 it will be noted that before application to the container 1 the closure cap is in the form of a one piece moulding comprising the inner member 4 and the outer member 5 interconnected by a frangible connection 6. In full lines in FIG. 5 the closure cap is shown in one piece before application to a container 1 and in dot and dash lines the closure cap is shown in its operative position. The closure cap as an integral unit is applied to a container 1 in a normal manner and top pressure is exerted on the closure cap to push the inner member 4 into the outer member 5, to break the frangible connection, to push the outer member 5 into a position to embrace the surface of the container around its mouth and to seat the inner member 4 on or in the mouth.

If desired a tamper-resistant feature may be incorporated by providing a web or webs 12, as shown in FIG. 6 connecting the top of the inner member to the outer member. The web or webs 12 must be broken before the inner member can be removed and breaking can readily be effected during rotation of the inner member to bring the thumb grip into registration with the gap or cut out. A broken web in the closure cap of what should be an unopened container gives a clear visual indication that the contents of the container may have been tampered with.

In a modification shown in FIG. 8 the outer member 5 has a continuous annular bead 8 on its inner surface i.e. without the interruption 13 and the inner member has a substantially annular bead 20 below a recess 22 on its outer surface with an interruption 21 therein as shown in FIG. 8, below the thumb grip 11. When the closure cap is in operative position the bead 20 is below the bead 8 which is within recess 22 and the thumb grip 11 is out of registration with the gap 10. When the inner member is manipulated to bring the thumb grip 11 into registration with the gap 10 the interruption 21 is below the gap 10 so that the beads 8 and 20 are not in engagement below the gap 10 and the inner member can be tilted and flicked out of the outer member.

In all cases the interruption should be of sufficient size to permit easy removal of the inner member e.g. 30° long. The gap 10 may be the same size or of different size so long as it is big enough to receive the thumb of a user.

We claim:

1. A closure cap for closing the mouth of a container comprising an inner member including a plug and an outer member including a depending skirt, characterized in that when the cap is in operative position on the container the inner member is coaxially disposed within the upper part of the outer member, the plug being seated so as to close the mouth of the container with the top of the inner member flush with or below the top of the outer member, the upper part of the outer member being positioned above the mouth of the container, and the skirt of the outer member being positioned so as to embrace and engage with the outer surface of the container around the mouth.

2. A closure cap as defined in claim 1, and further characterized in that the inner member can be removed without damaging the closure cap only when it has been turned into a predetermined position relative to the outer member.

3. A closure cap as defined in claim 2, and further characterized in that the outer member has a cut-out in its upper peripheral edge, and a substantially annular internal bead engaging with an annular external recess in the inner member, the internal bead being interrupted below or in the region of said cut-out, and wherein the inner member has a thumb grip adjacent to its upper edge and is rotationally adjustable within the outer member.

4. A closure cap as defined in claim 1, and further characterized in that the cap is molded as an integral unit with the inner member disposed coaxially above the outer member, the two parts being interconnected by a frangible connection which is broken when the closure cap is applied to a container.

5. A closure cap adapted for closing the mouth of a container comprising:

(a) an inner member including a plug with an external annular recess;

(b) an outer member including a depending skirt and having a gap or cut-out in its upper peripheral edge and a substantially annular internal bead to engage with the external annular recess in the inner member, the top of the outer member being flush with or above the top of the inner member;

(c) an interruption in the substantially annular internal bead on the outer member forming an opening below the gap or cut-out in the peripheral edge of the outer member;

(d) a thumb grip on the inner member normally masked by the outer member and adapted to be moved into operative position adjacent to the gap or cut-out by rotation of the inner member; and (e) a web or webs connecting the inner member to the outer member and further characterized in that when the closure cap is in operative position on a container the inner member is coaxially disposed within an upper part of the outer member with the plug seated in or over the mouth of the container so as to close the mouth, the upper part of the outer member is positioned above the mouth of the container and the skirt of the outer member is positioned so as to embrace and engage with the outer surface of the container around the mouth.

6. A closure cap as defined in claim 1, and further characterized in that the inner member is connected by a frangible connection to the outer member, the closure cap being applied to the container, which has an open mouth, by downward pressure so that the outer member is secured around the mouth of the container in the manner of a sleeve and the inner member is pressed into the outer member so as to seat in or on the mouth of the container by movement relative to the outer member so that the frangible connection is broken by the act of applying the closure cap to the container.

* * * * *